US010480246B2

(12) United States Patent
Püttmann et al.

(10) Patent No.: US 10,480,246 B2
(45) Date of Patent: Nov. 19, 2019

(54) PERCUSSION BORING DEVICE

(71) Applicant: TRACTO-TECHNIK GmbH & Co. KG, Lennestadt (DE)

(72) Inventors: Franz-Josef Püttmann, Lennestadt (DE); Gerhard Völkel, Erndtebrück (DE); Gerhard Balve, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 135 days.

(21) Appl. No.: 15/739,583

(22) PCT Filed: Jun. 28, 2016

(86) PCT No.: PCT/EP2016/001092

§ 371 (c)(1),
(2) Date: Dec. 22, 2017

(87) PCT Pub. No.: WO2017/001053

PCT Pub. Date: Jan. 5, 2017

(65) Prior Publication Data

US 2018/0363375 A1 Dec. 20, 2018

(30) Foreign Application Priority Data

Jul. 1, 2015 (DE) ..... 10 2015 008 340

(51) Int. Cl.
*E21B 1/00* (2006.01)
*E21B 4/14* (2006.01)

(52) U.S. Cl.
CPC ..... *E21B 1/00* (2013.01); *E21B 4/145* (2013.01)

(58) Field of Classification Search
CPC ..... E21B 1/00; E21B 1/02; E21B 4/14; E21B 4/06; E21B 10/36; E21B 4/16; E21B 10/40; E21B 10/60; E21B 10/38
USPC ..... 173/91, 206, 168
See application file for complete search history.

(56) References Cited

U.S. PATENT DOCUMENTS 5,172,771 A 12/1992 Wilson

FOREIGN PATENT DOCUMENTS

| | | |
|---|---|---|
| DE | 29518159 U1 | 1/1996 |
| DE | 69124461 T2 | 5/1997 |
| DE | 102009038385 A1 | 3/2011 |

OTHER PUBLICATIONS

International Search Report dated Sep. 12, 2016 for related PCT Application No. PCT/EP2016/001092.

*Primary Examiner* — David J Bagnell
*Assistant Examiner* — Manuel C Portocarrero
(74) *Attorney, Agent, or Firm* — Howard IP Law Group

(57) ABSTRACT

A percussion boring device with an impact piston is mounted within a housing and driven in a cyclic back and forth movement. In a first switch position, the impact piston strikes a front impact surface, in order to drive the percussion boring device in a first movement direction, and, in a second switch position, the impact piston strikes a rear impact surface, in order to drive the percussion boring device in a second movement direction. For the reversal of the movement directions, a guide tube fixed to the housing, and a control sleeve which can be axially shifted on the guide tube, are provided, and the impact piston can be axially shifted on the control sleeve. The control sleeve includes two sections which are connected to one another by a movable connection.

20 Claims, 2 Drawing Sheets

PERCUSSION BORING DEVICE

CROSS-REFERENCE TO RELATED APPLICATIONS

This application is a national phase application under 35 U.S.C. § 371 of International Patent Application No. PCT/EP2016/001092 filed Jun. 28, 2016, which claims priority to German Application No. 10 2015 008 340.6 filed Jul. 1, 2015, the entire contents of all of which are incorporated herein by reference for all purposes.

FIELD OF THE INVENTION

The invention relates to a percussion boring device.

BACKGROUND OF THE INVENTION

Percussion devices, as used in particular for producing horizontal ground boring devices, are generally driven by means of an impact piston which is moved back and forth within the housing and which, in the process, depending on the desired movement direction of the device, strikes a front or a rear impact surface. The kinetic energy of the impact piston transmitted thereby ensures acceleration of the percussion boring device within the ground.

In general, a reversal of the movement direction is achieved in that the central position (between the two reversal points) of the impact piston is shifted from a front position to a rear position or vice versa. Thus, depending on position, the impact piston strikes either the front or the rear impact surface and thereby defines the movement direction of the device.

From the prior art, various designs are known, by means of which the central position of the impact piston can be shifted, and thus the movement direction of the device can be changed.

For controlling the movement direction, a guide tube which is fixed on the housing and a control sleeve which can be axially shifted on the guide tube are used, wherein the impact piston can be axially shifted on the control sleeve. In particular, if the impact piston can be axially shifted on a control sleeve and the control sleeve has a great length, the impact piston can act on the control sleeve during the movement, warping the control sleeve, for example, as a result of which the service life of the control sleeve can be reduced, which causes increased repair and/or maintenance costs. Furthermore, in this case, due to increased friction, the performance of the percussion boring device can be strongly reduced. Moreover, it is possible that the housing of the percussion boring device is bent by lateral forces in the ground. In that case, the angular offset between control sleeve and impact piston can occur, as a result of which the impact piston and thus the entire percussion boring device can reach a standstill.

SUMMARY OF THE INVENTION

Therefore, the aim of the invention is to create an improved percussion boring device which can have an improved performance, a longer service life, a lower tendency to seize and/or an increased lifespan.

This aim is achieved by the subject matter disclosed herein. Advantageous designs are mentioned herein.

The core idea of the invention is that the control sleeve comprises at least two sections, in particular in longitudinal direction, which are connected to one another by means of a movable connection which can be configured as a resilient connecting section and/or as an articulation. As a result, an increased length of the control sleeve can also be achieved, and a plastically acting influence which forms or deforms the control sleeve is prevented due to the movable connection. The movable connection can have a function corresponding to a floating bearing for one of the two sections of the control sleeve. In particular, the section can have no contact with the guide tube spaced apart from the movable connection. The movable connection can form a friction bearing for one of the two sections and a floating bearing for the other one of the two sections. The movable connection can be mounted on the guide tube, in order to implement the axial shiftability toward the guide tube and, in addition, enable a swiveling of a section toward the guide tube.

The invention creates a percussion boring device with an impact piston mounted within a housing and driven in a cyclical back and forth movement. In a first switch position, the impact piston strikes a front impact surface, in order to drive the percussion boring device in a first movement direction. In a second switch position, the impact piston strikes a rear impact surface, in order to drive the percussion boring device in a second movement direction. For the reversal between the two movement directions, the percussion boring device comprises a guide tube fixed to the housing and a control sleeve which can be axially shifted on the guide tube. The impact piston can be axially shifted on the control sleeve. The control sleeve comprises two sections connected to one another by means of a movable connection.

The connection of the two sections of the control sleeve by means of the movable connection can occur indirectly or directly via the connection. It is possible to provide that, for example, between a resilient connecting section and/or an articulation as movable connection and the two sections, other sections can be provided. Furthermore, the control sleeve is not limited to the presence of the two sections with a connecting section and/or an articulation. In addition to the two sections and the connecting section and/or the articulation, other sections of the control sleeve can be provided.

An inventive "percussion boring device" includes a self-driven impact device which works the ground by displacement and which can introduce a line or a pipe by impact into the ground. The term "ground" in the sense of the present invention includes, in particular, any type of existing or future, preferably horizontal, channels in a body, in particular ground channels including ground bores, rock bores or ground lines as well as underground or aboveground pipelines and water channels which can be produced or put in by using a corresponding percussion boring device.

The terms "connecting section" and "articulation" include the formation of a movable and/or articulated connection of the two sections of the control sleeve, which allows a relative movement of the two sections with respect to one another, in particular, a three-axis, two-axis or single-axis movement, wherein, in particular, a swivel movement of the two sections relative to one another is possible.

In a preferred embodiment, the connection is formed by means of a connecting section and/or articulation between a head section and a main body section of the control sleeve. The main body section of the control sleeve can be at least partially in contact with the guide tube. The head section of the control sleeve is formed so that, at least on the end side, i.e., spaced apart from the movable connection, it is spaced apart from the guide tube, and, in the end-side region of the head section of the control sleeve, it is not mounted on the guide tube; instead the impact piston and the head section of the control sleeve form guide surfaces relative to one another, along which the impact piston can be axially shifted relative to the control sleeve.

In a preferred embodiment, the two sections of the control sleeve have different outer diameters, and, in particular, different inner diameters. The inner diameter of one section, in particular of the main body section, is correspondingly adjusted to the outer diameter of the guide tube, so that it can be shifted axially relative to said guide tube. The outer diameter of the guide tube corresponds substantially to the inner diameter of the first section, in particular of the main body section. The outer diameter of the first section, in particular of the main body section, is configured in such a manner that a contact with the impact piston is not possible. The first section, in particular the main body section, comprises guide surfaces for the relative guiding of the first section on the guide tube. The inner diameter of the second section, in particular of the head section, is configured in such a manner that there is no contact in the end-side region of the second section with the guide sleeve. The outer diameter of the second section, in particular of the head section, is adjusted to the inner diameter of the impact piston, in order to form guide surfaces for the relative axial shiftability of the impact piston toward the control sleeve. The two sections can be connected to one another indirectly or directly by means of the movable connection comprising the resilient connecting section and/or the articulation.

In a preferred embodiment, the two sections of the control sleeve can be swiveled relative to one another on the guide tube. In particular, the section facing the impact piston can be swivelable against the other one of the two sections. It is possible to provide that, of the sections, the section which can be swiveled against the other section can also be swiveled relative to the guide tube, provided that the other one of the two sections is securely mounted such that it can be axially shifted on the guide tube.

In a preferred embodiment, the resilient connecting section and/or a partial section of the articulation is at least partially in contact with the guide tube and guided in an axially shiftable manner together with the control sleeve with respect to the guide tube, in order to form a bearing for one of the sections, by means of which one of the sections can receive an additional degree of freedom of the movement toward the guide tube.

In a preferred embodiment, the resilient connecting section and/or the articulation has an annular shape with an L-shaped cross section, so that a swiveling of one of the two sections is possible in a simplified manner due to the geometric formation.

In a preferred embodiment, the resilient connecting section includes a resiliently deformable plastic which, in particular, can keep its shape. The resilient connecting section can include an elastomer or an elastomer material or a resilient polymer, for example, rubber. Moreover, alternatively or additionally, the resilient connecting section can include a polyurethane. The term "include" covers the semantic contents of the terms "comprise" and "consist of," so that, in the one case, in addition to the one material or chemical compound mentioned, additional materials or chemical compounds can be present, and, in the other case, the pure material, except for unavoidable contaminants, is present.

In a preferred embodiment, the guide tube comprises an abutment, wherein the control sleeve comprises a correspondingly configured counter-element which, in one of the switch positions, is in contact with the abutment of the guide tube. In particular, the counter-element can be formed on the sections or connected to the section which can be swiveled with respect to the guide tube. As a result, it can become possible for the control sleeve to be brought in a switch position defined by the abutment and the counter-element.

In a preferred embodiment, an annular space is formed between the guide tube and the annular element which, in particular, is arranged fixedly relative to the guide tube. The annular space is covered at least partially on the front side by the control sleeve and connected to a control line which can be pressurized with a fluid. By means of the control line, the annular space can be pressurized, in order to extend the control sleeve from the annular space. Thereby, a reversal which can be carried out using simple means is possible. The fluid can be either a pressurized gas, in particular, pressurized air, or a fluid, so that the reversal can occur pneumatically or hydraulically from the switch position, before the extension of the control sleeve from the annular space, into the switch position with control sleeve extended out of the annular space. After reducing the pressure of the control line to a lower pressure, in particular, atmospheric pressure, the operating pressure applied to the control sleeve causes a resetting of the control sleeve.

In a preferred embodiment, in a front section of the two sections of the control sleeve, in particular on the head section, adjacent to the movable connection, a ventilation bore is formed, by means of which a pressure compensation is achieved. The ventilation bore can be formed in the front section of the two sections and/or in the movable connection. The pressure compensation can occur between the outer space surrounding the head section and the space formed between the head section, the guide tube and the abutment ring on the guide tube which, in particular, can form an inner guide for the head section of the control sleeve. As a result, the control sleeve can advance unimpededly. Then, in the space formed by the head section, the guide tube and the abutment ring, no pressure builds up, which could counteract a forward movement of the control sleeve. Preferably, the ventilation bore is formed in the rear region of the head section, i.e., adjacent to the movable connection, in order to ensure ventilation over the entire shifting path of the head section of the control sleeve toward the guide tube and the abutment ring formed on the guide tube. In particular, the ventilation bore can be formed on or near the counter-element of the head section which can cooperate with an abutment on the abutment ring. The ventilation bore can intersect the counter-element or it can be arranged adjacently to the counter-element.

The above designs like the following description of exemplary embodiments do not represent a renunciation of definite embodiments or features.

The invention is described in further detail below in reference to an embodiment example represented in the drawings.

DETAILED DESCRIPTION

Figure 1:
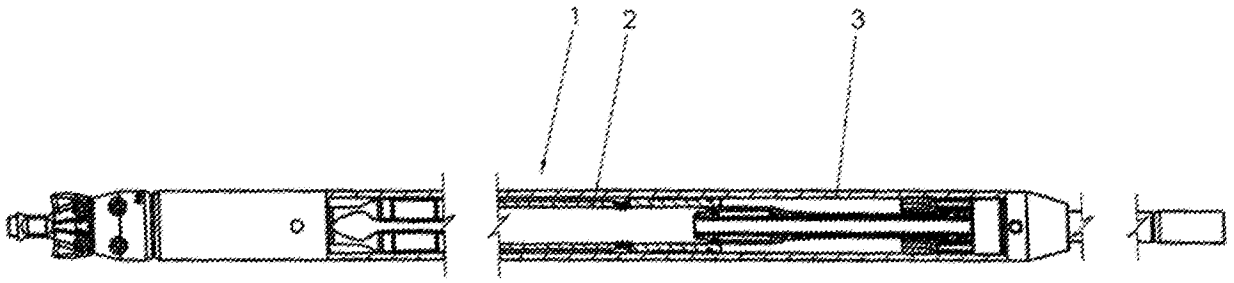
FIG. 1 shows a percussion boring device in a partially cut representation.

FIG. 1 shows a percussion boring device 1 for boring in the ground. On the end side, on the percussion boring device 1, on the left in the representation of FIG. 1, a bore head with a boring cutter is provided. The percussion boring device 1 comprises an impact piston 2 mounted within a housing 3. The impact piston 2 can be driven for a cyclical back and forth movement in the housing 3. In a first switch position, the impact piston 2 strikes a front impact surface, in order to drive the percussion boring device 1 in a first movement direction (to the left in the embodiment represented in FIG. 1). In a second switch position, the switch piston 2 strikes a rear impact surface, in order to drive the impact boring device in a second movement direction (to the right in the embodiment represented in FIG. 1).

For the reversal of the movement directions, the percussion boring device comprises a guide tube 5 fixed to the housing and a control sleeve 4 which can be axially shifted on the guide tube 5. The impact piston 2 can be axially shifted on the control sleeve 4. In particular from FIG. 2, one can see that the control sleeve 4 temporarily engages in the impact piston 2 during the axial shifting.

The control sleeve 4 comprises two sections 7, 8 which are connected to one another by means of a movable connection and which are configured to form head section 7 and main body section 8. In the embodiment example represented in FIGS. 1 to 3, the movable connection 6 is configured to form a resilient connecting section which is configured in such a manner that the two sections of the control sleeve 4 can swivel relative to one another. The movable connection 6 is connected to the main body section 8, and the head section 7 grips the resilient connecting section.

The main body section 8 of the control sleeve 4 is at least partially in contact with the guide tube 5. The head section 7 of the control sleeve 4 is formed on the inner side, spaced apart from the guide tube 5. The inner diameter of the head section 7 of the control sleeve 4, particularly at the end spaced apart from the main body section 8, is configured to be larger than the outer diameter of the guide tube 5. At the end of the head section 7, which is adjacent to the main body section 8, the head section 7 has a lower inner diameter than at the end of the head section 7, which is spaced apart from the main body section 8.

Figure 2:
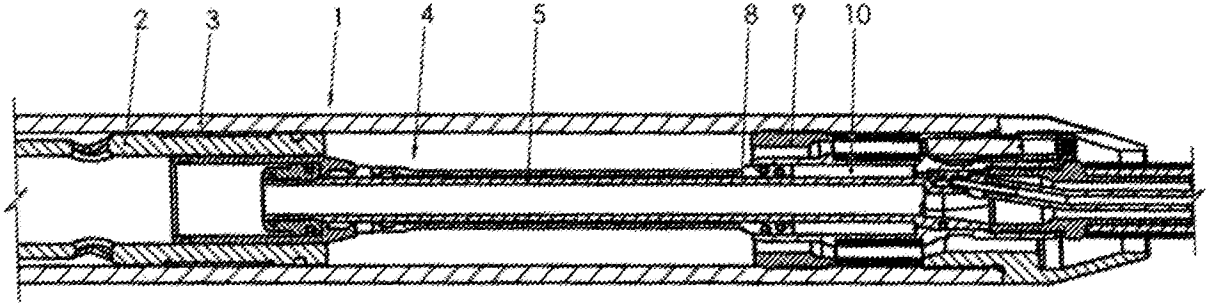
FIG. 2 shows the percussion boring device of FIG. 1 in an enlarged representation with extended control tube.

Connected to the guide tube 5, there is an abutment ring 12 which comprises an abutment for the control sleeve 4. For this purpose, on the head section 7 of the control sleeve 4, a counter-element configured in accordance with the abutment is configured, which, in the switch position of the control sleeve 4 relative to the guide tube 5, represented in FIG. 2, is in contact with the abutment of the guide tube 5. The abutment ring 12 can form with the outer circumference an inner guide for the head section 7 of the control sleeve 4.

In FIG. 2, an annular space 10 is represented, which is formed between the guide tube 5 and an annular element 9 which is arranged fixedly relative to the guide tube 5. The annular space 10 is delimited at least partially on the front side by the control sleeve 4 and connected to a control line 11 which can be pressurized with a fluid. By means of the control line 11, the annular space 10 can be pressurized, in order to extend the control sleeve 4 out of the annular space 10. If the pressurization of the annular space 10 is stopped, a retraction and/or a resetting of the control sleeve 4 is brought about by means of the operating pressure applied to the control sleeve 4.

Figure 3:
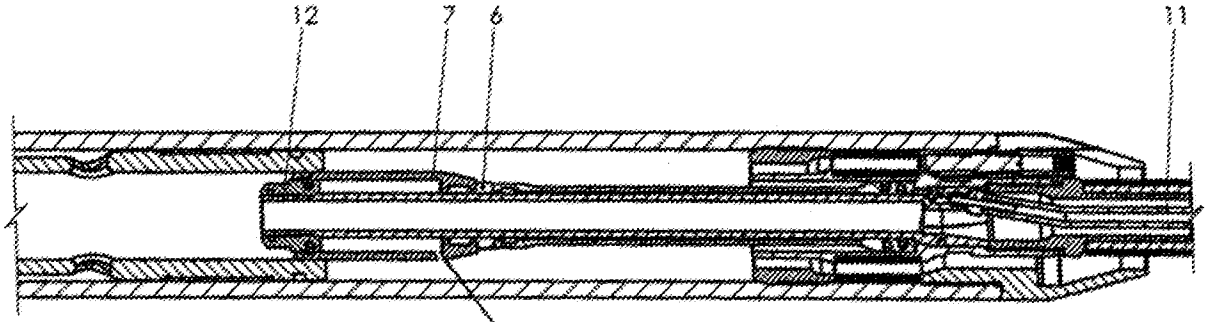
FIG. 3 shows the representation according to FIG. 2 with retracted control tube.

FIG. 3 shows, as an example for FIG. 2, a ventilation bore 13 which is formed in the head section 7 of the control sleeve 4, in order to establish a pressure compensation.

The invention claimed is:

1. A percussion boring device comprising:
a housing;
a guide tube fixed to the housing;
a control sleeve axially displaceable on the guide tube, said control sleeve having at least a first sleeve section, a second sleeve section, and a movable connector movably connecting the first sleeve section and the second sleeve section;
an impact piston mounted within the housing and axially displaceable on the control sleeve such that in a first switching position the impact piston strikes a front impact surface and drives the percussion boring device in a first movement direction, and, in a second switching position said impact piston strikes a rear impact surface and drives the percussion boring device in a second movement direction.

2. The percussion boring device of claim 1, wherein the first sleeve section comprises a head section of the control sleeve and the second sleeve section comprises a main body section of the control sleeve.

3. The percussion boring device of claim 1, wherein a first region of the first sleeve section has a different outer diameter than a second region of the second sleeve section.

4. The percussion boring device of claim 1, wherein the movable connector is configured to swivel the first sleeve section and the second sleeve section relative to one another on the guide tube.

5. The percussion boring device of claim 1, wherein the movable connector comprises one of a resilient connector and an articulating connector, and wherein the movable connector is at least partially in contact with the guide tube.

6. The percussion boring device of claim 5, wherein the movable connector comprises the resilient connector, and wherein the resilient connector comprises a deformable plastic.

7. The percussion boring device of claim 1, wherein the movable connector comprises an annular connector having an L-shaped cross section.

8. The percussion boring device of claim 1, wherein the guide tube comprises an abutment, and the control sleeve comprises a counter-element which is in contact with the abutment when the percussion boring device is in one of the first switching position and the second switching position.

9. The percussion boring device of claim 1, further comprising an annular element within the housing which forms an annular space between the guide tube and the annular element, wherein the annular space is at least partially covered by the control sleeve, and wherein the annular space is in fluid communication with a control line.

10. The percussion boring device of claim 1, wherein the first sleeve section comprises a head section of the control sleeve and includes a ventilation bore.

11. The percussion boring device of claim 1, wherein the movable connector includes a ventilation bore.

12. A percussion boring device comprising:
a housing extending longitudinally from a front impact surface to a rear impact surface;
a guide tube extending longitudinally within the housing, wherein the guide tube is fixed to the housing;
a control sleeve longitudinally displaceable on the guide tube, said control sleeve having at least a first sleeve section, a second sleeve section, and a movable connector connecting the first sleeve section and the second sleeve section;
an impact piston mounted within the housing and longitudinally displaceable on the control sleeve such that in a first switching position the impact piston strikes the front impact surface and drives the percussion boring device in a first movement direction, and, in a second switching position said impact piston strikes the rear impact surface and drives the percussion boring device in a second movement direction.

13. The percussion boring device of claim 12, wherein the movable connector indirectly connects the first sleeve section and the second sleeve section.

14. The percussion boring device of claim 12, wherein the first sleeve section comprises a head section of the control sleeve and the second sleeve section comprises a main body section of the control sleeve which is at least partially in contact with the guide tube.

15. The percussion boring device of claim 14, wherein the head section is movably attached to an end of the guide tube such that a portion of the head section extends longitudinally beyond the end of the guide tube; and wherein the head section has an outer diameter configured to correspond to an inner diameter of the impact piston such that the head section and the impact piston form guide surfaces relative to one another that facilitate longitudinal displacement of the impact piston relative to the control sleeve.

16. The percussion boring device of claim 14, wherein the main body section of the control sleeve has an inner diameter configured to correspond to an outer diameter of the guide tube to facilitate longitudinal displacement of the main body section of the control sleeve on the guide tube.

17. The percussion boring device of claim 14, wherein the movable connector is configured to swivel the head section of the control sleeve relative to the main body section of the control sleeve.

18. The percussion boring device of claim 14, wherein the guide tube comprises an abutment, and the head section of the control sleeve comprises a counter-element which is in contact with the abutment when the percussion boring device is in one of the first switching position and the second switching position.

19. The percussion boring device of claim 14, further comprising an annular element within the housing which has a fixed position relative to the guide tube, wherein the annular element is coaxial with the guide tube and forms an annular space between the guide tube and the annular element, wherein the main body section of the control sleeve abuts the annular space; and wherein the annular space is in fluid communication with a control line and is configured to be pressurized or depressurized with fluid from the control line, wherein pressurization or depressurization of the annular space causes the main body section of the control sleeve to be displaced on the guide tube.

20. The percussion boring device of claim 19, wherein one of the head section of the control sleeve and the movable connector includes a ventilation bore which reduces pressure buildup that impedes the displaceability of the control sleeve.

* * * * *